US006230490B1

(12) United States Patent
Suzuki et al.

(10) Patent No.: US 6,230,490 B1
(45) Date of Patent: May 15, 2001

(54) EXHAUST MANIFOLD FOR INTERNAL COMBUSTION ENGINES

(75) Inventors: Takehiro Suzuki, Hamamatsu; Akira Tomari, Honjo, both of (JP)

(73) Assignees: Suzuki Motor Corp.; Sankei Giken Industry Co., Ltd., both of (JP)

( * ) Notice: Subject to any disclaimer, the term of this patent is extended or adjusted under 35 U.S.C. 154(b) by 0 days.

(21) Appl. No.: 09/433,364

(22) Filed: Nov. 3, 1999

(30) Foreign Application Priority Data

Nov. 9, 1998 (JP) ..... 10-333407
Nov. 9, 1998 (JP) ..... 10-333408

(51) Int. Cl.[7] ..... F01N 7/10
(52) U.S. Cl. ..... 60/323; 60/321
(58) Field of Search ..... 60/321, 323; 165/51

(56) References Cited

U.S. PATENT DOCUMENTS 4,373,331 * 2/1983 Santiago et al. ..... 60/323
4,386,586 * 6/1983 Santiago et al. ..... 60/323
4,731,993 * 3/1988 Ito et al. ..... 60/323
5,144,800 * 9/1992 Shioya et al. ..... 60/323
6,009,706 * 1/2000 Haneda ..... 60/323
6,018,946 * 2/2000 Matsumoto ..... 60/323

FOREIGN PATENT DOCUMENTS

3333591 * 3/1985 (DE) ..... 60/323
321343 * 6/1989 (EP) ..... 60/323
0108817 * 6/1984 (JP) ..... 60/323
099612 * 5/1987 (JP) ..... 60/323
0170515 * 7/1988 (JP) ..... 60/323
363179142 * 7/1988 (JP) ..... 60/323
12021 * 1/1989 (JP) ..... 60/323
406229238 * 8/1994 (JP) ..... 60/323
8-007055 2/1996 (JP) .
8-260958 10/1996 (JP) .
9-280045 10/1997 (JP) .
9-317462 12/1997 (JP) .
10089060 4/1998 (JP) .
10089064 4/1998 (JP) .

* cited by examiner

*Primary Examiner*—Thomas Denion
*Assistant Examiner*—Diem Tran
(74) *Attorney, Agent, or Firm*—Morrison Law Firm

(57) ABSTRACT

An exhaust manifold is constructed of material varying in thickness. Auxiliary cooling, such as from an air flow, to a portion of the exhaust manifold, permits making this portion thinner than a portion shielded from the auxiliary cooling. This lowers the heat capacity of the thinner material, allowing the exhaust manifold to heat rapidly to the activation temperature of a catalyst. Thus, the catalyst is capable of removing harmful elements from the exhaust gases of an internal combustion engine more quickly, thereby reducing pollution to the atmosphere. Furthermore, an exhaust manifold having this structure is lighter and requires less material than conventional exhaust manifolds, thereby making production easier and less costly.

14 Claims, 7 Drawing Sheets

EXHAUST MANIFOLD FOR INTERNAL COMBUSTION ENGINES

BACKGROUND OF THE INVENTION

The present invention relates to an exhaust manifold for internal combustion engines. More specifically, the present invention relates to an exhaust manifold for internal combustion engines that allows early activation of a catalyst immediately after starting, reduces weight and costs, increases joining precision between plate materials, and improves welding precision.

Internal combustion engines have an exhaust manifold to collect exhaust gas discharged from gas columns. A catalyst is disposed following the exhaust manifold to purge harmful components of the exhaust gas from the exhaust manifold.

Exhaust manifolds for internal combustion engines include exhaust manifolds integrally formed by casting, as well as exhaust manifolds formed by joining a plurality of plate materials.

Examples of these exhaust manifolds for internal combustion engines are disclosed in Japanese examined utility model publication number 8-7055, Japanese laid-open patent publication number 10-89064, Japanese laid-open patent publication number 8-260958, Japanese laid-open patent publication number 9-317462, and Japanese laid-open patent publication number 10-89060.

Japanese examined utility model publication number 8-7055 discloses two plate materials joined to form an exhaust pipe collecting section. Of the two plate materials, the one that faces the main engine unit is formed thinner than the plate material positioned on the other side of the main engine unit. This difference in thickness generates a difference in vibration frequencies between the two plate materials, thereby reducing vibration noise. Also, the thicker plate material on the opposite side from the main engine unit restricts the transmission of exhaust noise.

Japanese laid-open patent publication number 10-89064 discloses the joining together of a front half, a partitioning body, and a rear half, each formed as plates. A plurality of exhaust pipes and confluence sections between two exhaust pipes are formed from the partitioning body and either the front half or the rear half. This allows for the reduced thickness and weight of the exhaust manifold.

Japanese laid-open patent publication number 8-260958 discloses junctures between the branching pipes that are made thicker than the other sections. The thickness is made greatest at the juncture disposed at the longitudinal center of the cylinder head. This increases the compressive stress generated at the junctures.

Japanese laid-open patent publication number 9-317462 discloses an outer pipe and an inner pipe, supported in the outer pipe, so that the two are separated by a gap. The outer pipe is formed so that the gap is larger near the engine attachment flange. This allows the thermal transfer from the inner pipe to the outer pipe to be reduced while allowing the exhaust temperature guided to the catalyst to quickly rise when the engine is started.

Japanese laid-open patent publication number 10-89060 discloses a vertically oriented engine having an exhaust port with an exit-side opening positioned higher toward the front or the rear of the automobile. The branching pipes, continuous with the exit-side opening, are positioned outward. This reduces the overlap between the branching pipes, when seen from the front of the automobile. As a result, the variations in the running airstreams that come into contact with the branching pipes are reduced and thermal warping is prevented.

Internal combustion engines use a catalyst to reduce harmful elements in the exhaust gas. The catalyst efficiently purges harmful elements when the catalyst temperature reaches its activation temperature.

In recent years, there has been an increasing demand for reducing harmful elements in the exhaust gas. In particular, there has been a demand to reduce the harmful elements in the exhaust gas that is discharged immediately after an internal combustion engine is started, since, at this time, the catalyst temperature is too low for the catalyst to be effective in removing the harmful elements.

For this reason, an exhaust manifold for internal combustion engines is formed by joining plate material having a smaller heat capacity than that of an exhaust manifold formed by casting. This allows the catalyst temperature to rise to the activation temperature quickly after the engine is started, thus providing early activation of the purging effect.

Referring to FIG. 12, there is shown an example of this type of exhaust manifold for internal combustion engines. Referring to FIG. 12, there is shown an engine compartment 102 for an automobile (not shown in the figure). An internal combustion engine 104, a cylinder head 106, and an exhaust manifold 108 are mounted in engine compartment 102. Exhaust manifold 108 is formed by welding an upper case 110 and a lower case 112. Upper case 110 and lower case 112 are formed as two metal sheets.

Exhaust manifold 108 attaches to cylinder head 106 with a head attachment flange 114. A catalyst (not shown in the figure) is attached to a catalyst attachment flange 116. When internal combustion engine 104 is mounted sideways in engine compartment 102 toward the front of the automobile (not shown in the figure), exhaust manifold 108 is disposed to the front of internal combustion engine 104.

Exhaust manifold 108 is generally formed so that a sheet thickness t1 of upper case 110 and a sheet thickness t2 of lower case 112 are identical (t1=t2). Exhaust manifold 108 is cooled by air currents flowing through engine compartment 110 such as cooling air from a radiator fan (not shown in the figure) and running airflow.

Since upper case 110 is positioned further toward the front than lower case 112, relative to the direction of the air currents, upper case 110 is cooled more than lower case 112.

The stress tolerance of the metal sheets forming upper case 110 and lower case 112 increases for lower temperatures. Also, the heat capacity of the metal sheets is smaller if the thickness of the sheets is smaller.

Upper case 110 and lower case 112 are formed with the same sheet thickness (t1=t2) based on the stress tolerance of lower case 112, which receives less cooling from air flows. As a result, there is excess strength in upper case 110, which is cooled more than lower case 112, and therefore has a larger stress tolerance. This increases the amount of required materials, the weight, and the production costs. Furthermore, upper case 110 has a higher heat capacity. In particular, the temperature of the exhaust gas sent to the catalyst immediately after internal combustion engine 102 is started is reduced, thus lengthening the time required for the catalyst to be heated to its activation temperature.

OBJECTS AND SUMMARY OF THE INVENTION

It is an object of the present invention to provide an exhaust manifold for an internal combustion engine which overcomes the foregoing problems.

It is a further object of the present invention to provide an exhaust manifold for an internal combustion engine which allows for activation of a catalyst immediately after starting the internal combustion engine.

It is another object of the present invention to provide an exhaust manifold for an internal combustion engine which reduces weight and costs, increases joining precision between plate materials, and improves welding precision.

The present invention provides an exhaust manifold disposed to collect exhaust gas from gas columns of an internal combustion engine mounted in an engine compartment of an automobile. The exhaust manifold is formed by joining at least two sheet materials. One of the sheet materials, positioned toward the front, relative to a direction of an air current flowing through the engine compartment, is formed with a thickness less than a thickness of an other sheet material, positioned toward the rear, relative to the current flow direction Briefly stated, the present invention provides an exhaust manifold constructed of material varying in thickness. Auxiliary cooling, such as from an air flow, to a portion of the exhaust manifold, permits making this portion thinner than a portion shielded from the auxiliary cooling. This lowers the heat capacity of the thinner material, allowing the exhaust manifold to heat rapidly to the activation temperature of a catalyst. Thus, the catalyst is capable of removing harmful elements from the exhaust gases of an internal combustion engine more quickly, thereby reducing pollution to the atmosphere. Furthermore, an exhaust manifold having this structure is lighter and requires less material than conventional exhaust manifolds, thereby making production easier and less costly.

According to an embodiment of the present invention, there is provided an exhaust manifold comprising: at least one structure for receiving exhaust gas from an engine; the at least one structure having a first section, having a first thickness, which receives auxiliary cooling during operation of the engine, and a second section, having a second thickness; the second section receiving less auxiliary cooling than said first section; and the first thickness being less than the second thickness.

According to another embodiment of the present invention, there is provided an exhaust manifold for a V-shaped internal combustion engine, comprising: a first, front manifold structure receiving exhaust gas from a first side of the V-shaped internal combustion engine; a second, rear manifold structure receiving exhaust gas from a second side of the V-shaped internal combustion engine; the first, front manifold structure receiving auxiliary cooling from operation of the V-shaped internal combustion engine; and the first, front manifold structure being made from a material having a thickness less than the second, rear manifold structure, thereby reducing the overall heat capacity of the exhaust manifold.

According to a feature of the present invention, there is provided an exhaust manifold for an internal combustion engine comprising: a plurality of branching pipes, each receiving an exhaust gas from the internal combustion engine; the plurality of branching pipes connecting to a connecting pipe; each of the plurality of branching pipes having at least a first thickness and a second thickness; the first thickness, receiving auxiliary cooling during operation of the internal combustion engine, being thinner than the second thickness, thereby reducing the overall heat capacity of the exhaust manifold.

The above, and other objects, features and advantages of the present invention will become apparent from the following description read in conjunction with the accompanying drawings, in which like reference numerals designate the same elements.

DETAILED DESCRIPTION OF THE INVENTION

An exhaust manifold for internal combustion engines, according to the present invention, is formed by joining at least two sheets. These sheets are formed so that the thickness of the sheet positioned toward the front, relative to the air current flow in an engine compartment, is less than the thickness of the sheet positioned toward the rear, relative to the flow. Since the sheet positioned toward the front, relative to the air current flow, is efficiently cooled, there is greater stress tolerance. Thus, the front sheet can be made thinner, without resulting in reduced strength. This provides decreased heat capacity and reduces the amount of required material. The decrease in heat capacity permits more rapid heating, and thus earlier effectiveness of the catalyst.

Figure 6:
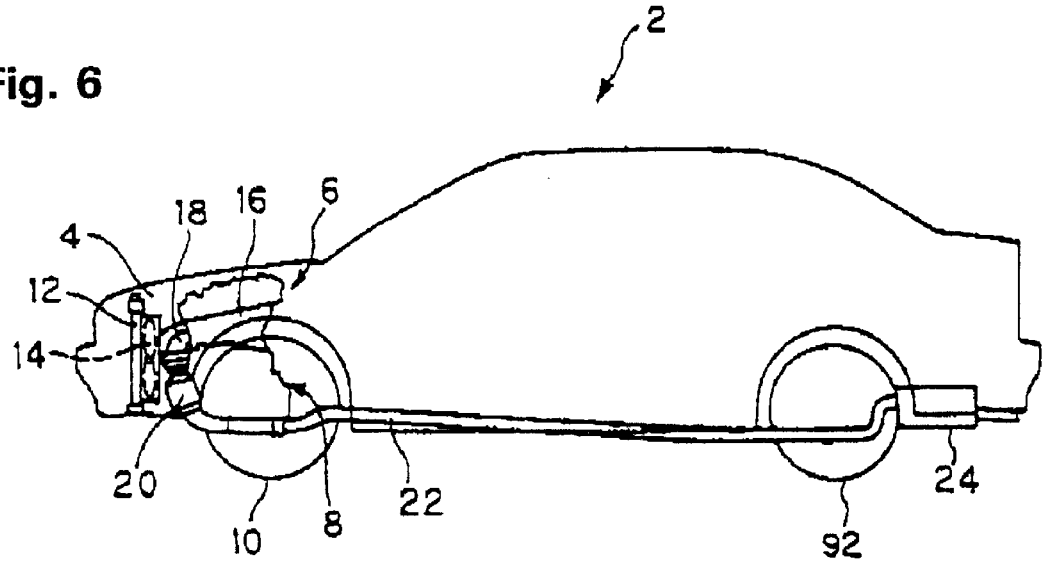
FIG. 6 is a transparent side-view drawing of an automobile.

Referring to FIG. 6, automobile 2 has an engine compartment 4 which contains an internal combustion engine 6. A transmission 8 attaches internal combustion engine 6 to a front wheel 10 and a rear wheel 92. Automobile 2 acquires drive force by using transmission 8 to convert the drive force from internal combustion engine 6 mounted toward the front of automobile 2.

A radiator 12 is in front of internal combustion engine 6. A radiator fan 14 is positioned to cool radiator 12.

An exhaust manifold 18 attaches to a cylinder head 16 of internal combustion engine 6 in order to collect the exhaust gas discharged from the gas columns (not shown in the figure) toward the front of automobile 2. Exhaust manifold 18 connects, in sequence, to a catalyst 20, an exhaust gas pipe 22, and a muffler 24. The exhaust gas, collected by exhaust manifold 18, is purged of harmful elements by catalyst 20 and discharged to the atmosphere by exhaust gas pipe 22 through muffler 24. Exhaust manifold 18 is formed by the joining together of at least two sheets.

Referring to FIGS. 2 through 5, exhaust manifold 18, according to this embodiment of the present invention, includes branching pipes 26, preferably formed from cylindrical sheets, and an upper case 28 and a lower case 30, preferably formed from bent sheets.

Figure 1:
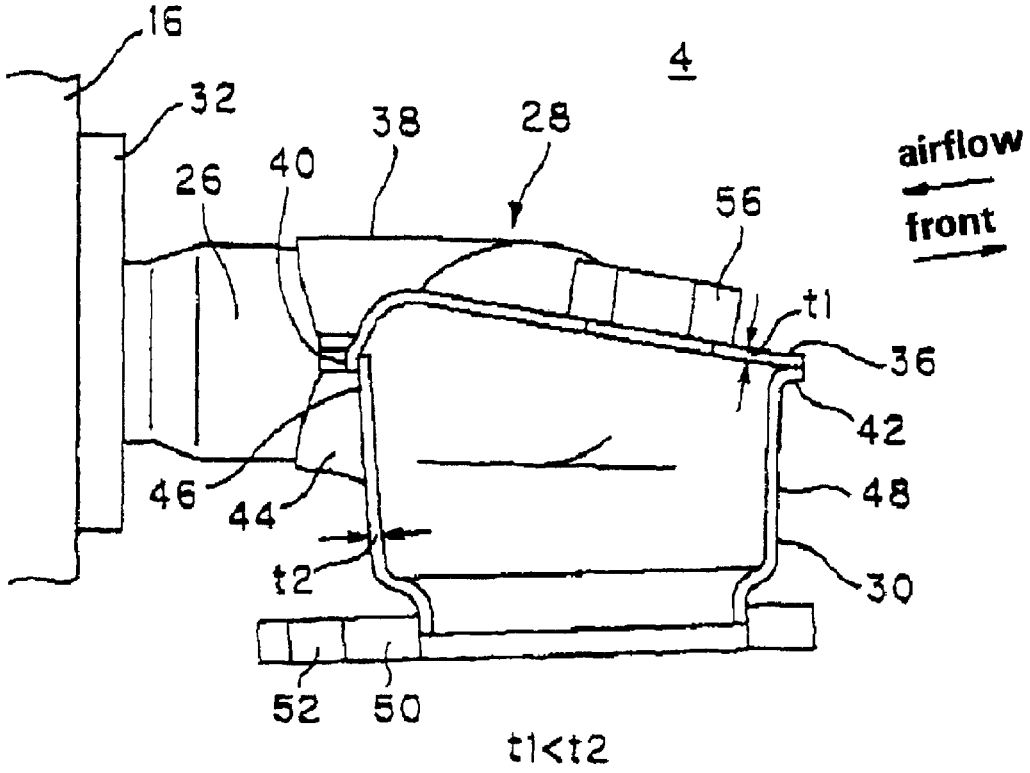
FIG. 1 is a cross-section detail drawing along the I—I line from FIG. 4 of an exhaust manifold for internal combustion engines according to an embodiment of the present invention.

Referring to FIG. 1, exhaust manifold 18 is formed so that a thickness t1 of upper case 28 and a thickness t2 of lower case 30 are different. Thickness t1 of upper case 28, which is positioned to the front, relative to the air current flow, in engine compartment 4, is thinner than thickness t2 of lower case 30, which is positioned to the rear, relative to the air current flow, (t1<t2).

Each of the plurality of branching pipes 26 is cylindrically formed from sheet material, with one end fixed to a heat attachment flange 32. A head attachment opening 34 (see FIG. 5) is disposed on heat attachment flange 32.

Upper case 28 is formed from a sheet material bent roughly in the shape of a crescent. An upper joining section 36 is disposed at the edge of one lateral side. On the other lateral side is disposed a plurality of upper fixing sections 38, which are formed as half-cylinders fixed to semicircular perimeter sections of branching pipes 26. At the edges of this other lateral side, between upper fixing sections 38, are disposed upper offset joining sections 40.

Lower case 30 is formed from a sheet material bent roughly in the shape of a crescent. A lower joining section 42, which joins with upper joining section 36, is disposed at an edge of one lateral side. On the other lateral side, a plurality of lower fixing sections 44, which are formed as half-cylinders that fit against upper fixing sections 38, are positioned. Flat lower joining sections 46 are disposed at the edges of this other lateral side between lower fixing sections 44. The lower fixing sections 44 engage with and are joined to upper offset joining sections 40.

A collecting section 48, extending in a downward direction in FIG. 1, is positioned on lower case 30. A catalyst attachment flange 50 is fixed to the open end of collecting section 48. A catalyst attachment opening 52 is formed on catalyst attachment flange 50.

Upper case 28 and lower case 30 are joined by abutting the lateral sides of upper joining section 36 and lower joining section 42. On the other lateral side, upper fixing section 38 is fitted to lower fixing section 44. The ends of branching pipes 26 are fixed, and upper offset joining sections 40 and lower joining sections 46 on the other lateral side are engaged and joined to form exhaust manifold 18.

Exhaust manifold 18 attaches to cylinder head 16 by inserting a head-side attachment bolt (not shown in the figure) disposed on cylinder head 16 through head attachment opening 34 on head attachment flange 32 and screwing an attachment nut (not shown in the figure) to the bolt.

Figure 2:
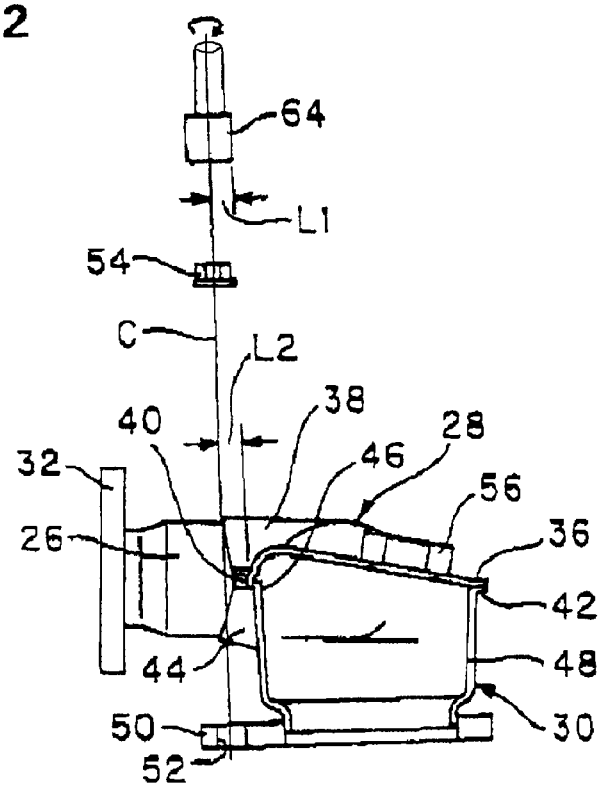
FIG. 2 is a cross-section drawing of an exhaust manifold.
Figure 3:
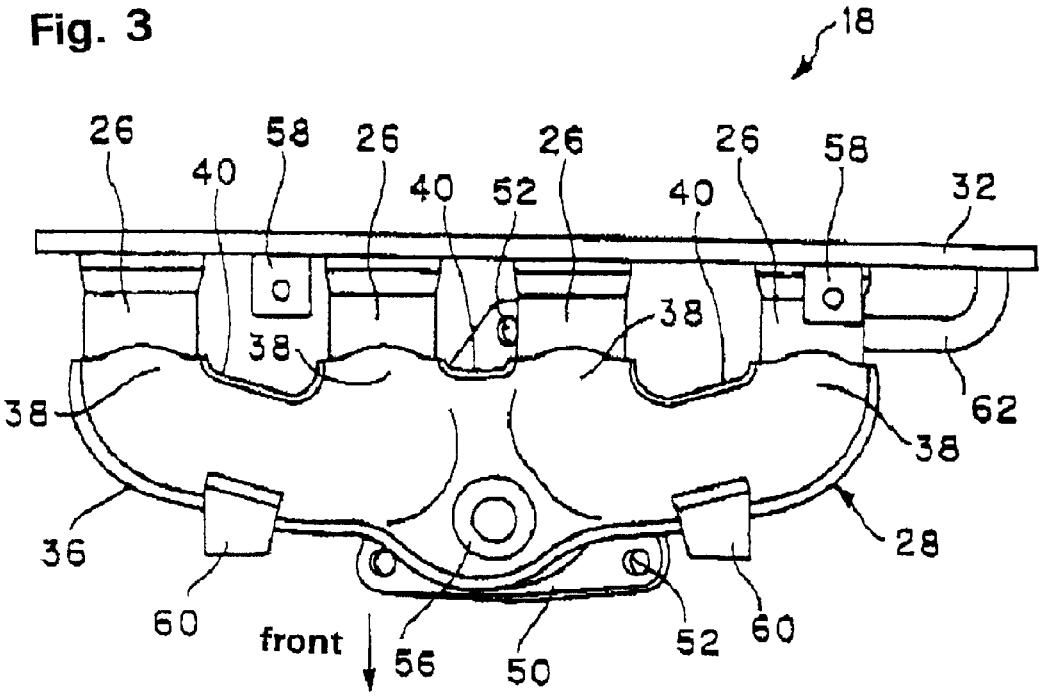
FIG. 3 is a plan drawing of an exhaust manifold.
Figure 4:
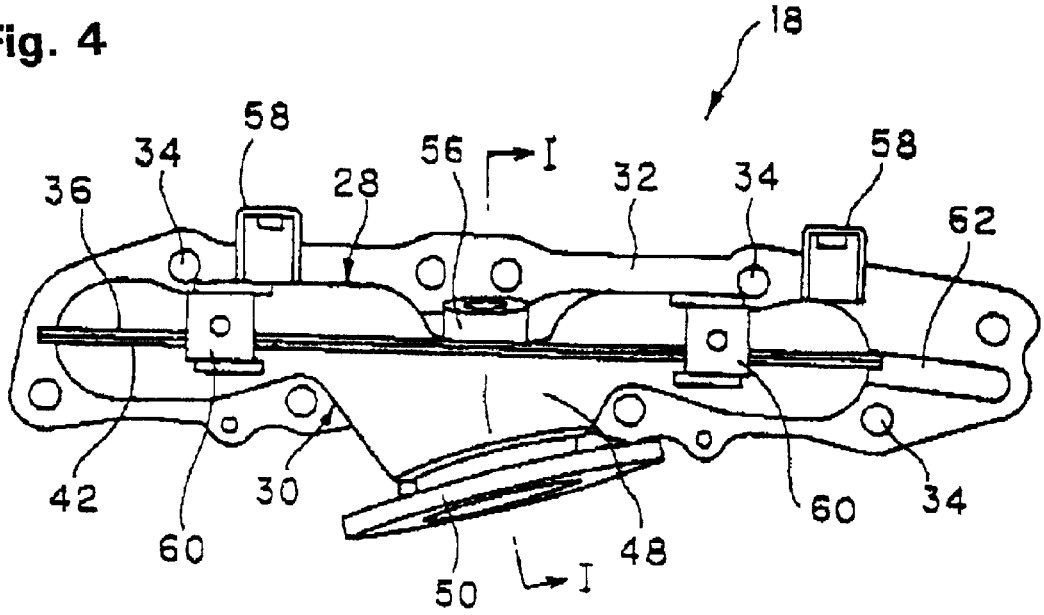
FIG. 4 is a front-view drawing of an exhaust manifold.
Figure 5:
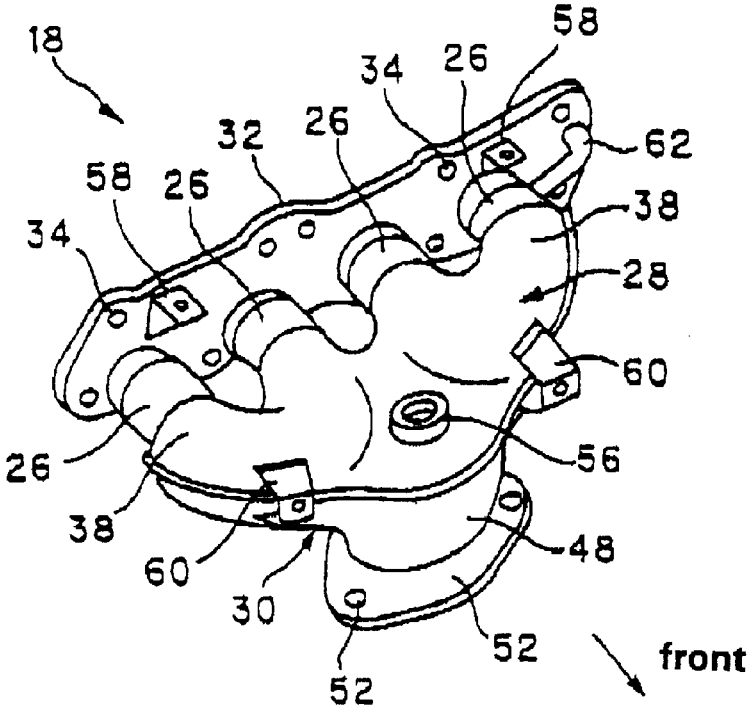
FIG. 5 is a perspective drawing of an exhaust manifold.

Referring to FIGS. 2 and 3, catalyst 20 attaches to exhaust manifold 18 by inserting an attachment bolt (not shown in the figure), disposed on catalyst 20, through catalyst attachment opening 52, formed on catalyst attachment flange 50, and screwing on an attachment nut 54. An $O_2$ sensor attachment boss 56, a flange-side cover attachment bracket 58, a case-side cover attachment bracket 60, and an EGR pipe 62 are each attached to exhaust manifold 18.

The following is a description of the operations performed by the structure described above.

Exhaust manifold 18 collects exhaust gas from the gas columns of internal combustion engine 6, which is mounted in engine compartment 4 of automobile 2. Harmful elements are purged by catalyst 20. The exhaust gas is then discharged to the outside atmosphere through exhaust gas pipe 22 via muffler 24.

Referring to FIG. 1, exhaust manifold 18, which collects the exhaust gas from the gas cylinders of internal combustion engine 6, is formed with thickness t1 of upper case 28 being different from thickness t2 of lower case 30. Upper case 28 and lower case 30 are formed so that thickness t1 of upper case 28, positioned toward the front, relative to the air current flow in engine compartment 4, is less than thickness t2 of lower case 30, positioned toward the rear, relative to the air current flow (t1<t2).

As a result, exhaust manifold 18 is cooled efficiently if it is positioned toward the front, relative to the air current flow from radiator fan 14, air currents flowing through engine compartment 4, or the like. This increases the stress tolerance of exhaust manifold 18, thus allowing upper case 28, positioned toward the front, relative to the air current flow, to be formed with thinner sheets without a loss of strength. This allows the heat capacity of upper case 28 to be reduced in addition to reducing the amount of materials required.

Since the above exhaust manifold 18 allows the heat capacity to be reduced, the exhaust gas can be guided to catalyst 20 immediately after internal combustion engine 2 is started, with reduced drop in the exhaust gas temperature. This allows catalyst 20 to be heated to its activation temperature in a shorter period of time, reducing the time, after starting the engine, for catalyst 20 to be activated to purge harmful elements. Also, by reducing the amount of required materials, the structure is made lighter and less expensive.

Referring to FIG. 2, in exhaust manifold 18, attachment nut 54 is screwed onto the attachment bolt (not shown in the figure) of catalyst 20 inserted into catalyst attachment opening 52 of catalyst attachment flange 50. Attachment nut 54 is tightened using a tool 64.

Thus, if there is a shift in the joining between upper case 28 and lower case 30, a distance L1 from a tightening center C to an outer edge of tool 64 may be less than a distance L2 to an outer edge of upper case 28. This would obstruct the use of tool 64.

To prevent this, exhaust manifold 18 is formed so that an upper offset joining section 40 is disposed as an offset at the edge of upper case 28, having thickness t1. This ensures that distance L2, from tightening center C to the outer edge of upper case 28, is larger than distance L1, from tightening center C to the outer edge of tool 64 (L1<L2). Upper offset joining section 40 is engaged and joined to lower joining section 46 at the edge of thicker lower case 30, having thickness t2.

By having upper offset joining section 40, which is disposed at the edge of thinner upper case 28, having thickness t1, engaged with lower joining section 46 of the edge of thicker lower case 30, having thickness t2, upper case 28 and lower case 30 are accurately positioned when they are joined. Thus, the joining precision and the welding precision of exhaust manifold 18 is improved. Furthermore, shifting between upper case 28 and lower case 30 is prevented. This prevents the obstructions to the operation of tool 64. Also, by forming upper offset joining section 40 at the edge of thinner upper case 28, with thickness t1, the structure is easily formed.

Figure 7:
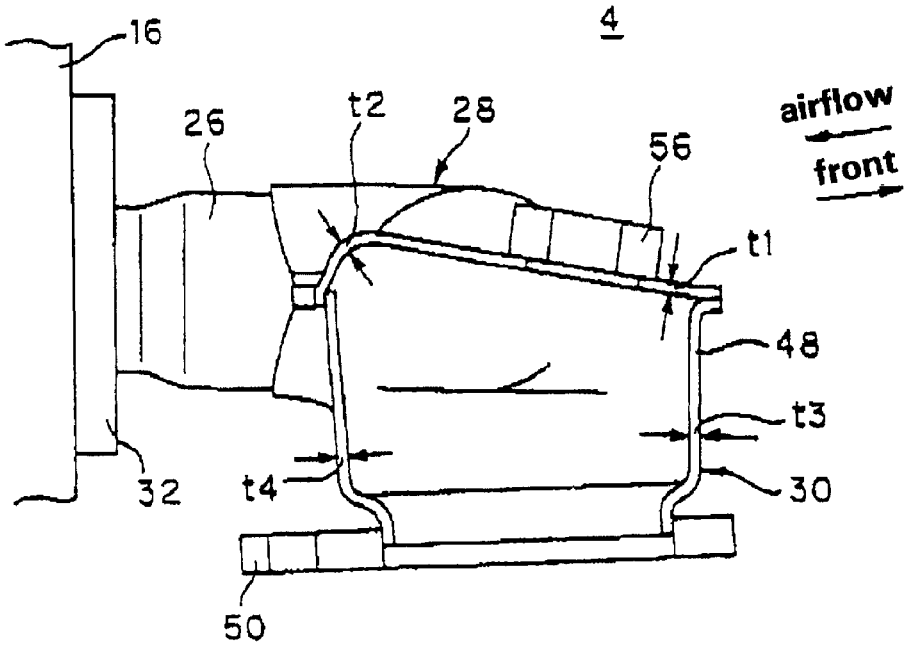
FIG. 7 is a cross-section detail drawing of an exhaust manifold according to another embodiment.

Referring to FIG. 7, in this alternate embodiment of the present invention, upper case 28 and lower case 30 of exhaust manifold 18 are formed so that the sections positioned toward the front, relative to the direction of the air current flow in engine compartment 4, are formed thinner than the sections positioned toward the rear, relative to the current flow.

In exhaust manifold 18, if the thickness of the section of upper case 28 toward the front, relative to the air current flow, is t1, the thickness of the section of upper case 28 toward the rear, relative to the air current flow, is t2, the thickness of the section of lower case 30 toward the front, relative to the air current flow, is t3, and the thickness of the section of lower case 30 toward the rear, relative to the air current flow, is t4, then the thicknesses are formed at least so that t1<t2 or at least so that t3<t4, with the relation between t2 and t3 being unimportant. Furthermore, it is also possible for the relationship between the thicknesses to be t1<t2<=t3<=t4, t1<=t2<t3<=t4, or t1<t2<t3<t4.

Thus, in exhaust manifold 18 according to this alternate embodiment of the present invention, the differences in cooling states, depending on the position relative to the direction of air current flow, is reflected in the thicknesses of upper case 28 and lower case 30 so that they are thinly formed without reducing their strength. This provides reduced heat capacity and requires less materials.

Thus, as with the previous embodiment, exhaust manifold 18, according to this alternate embodiment of the present invention, guides exhaust gas to catalyst 20 immediately after internal combustion engine 2 is started, without resulting in a drop in the exhaust gas temperature. This reduces the time it takes for the temperature of catalyst 20 to rise to its activation temperature, thus allowing catalyst 20 to be activated quickly, once the engine is started, so that it can purge harmful elements. Also, the resulting structure is made lighter and less expensive.

The present invention is not restricted to the embodiments described above, and various modifications may be made.

Figure 8:
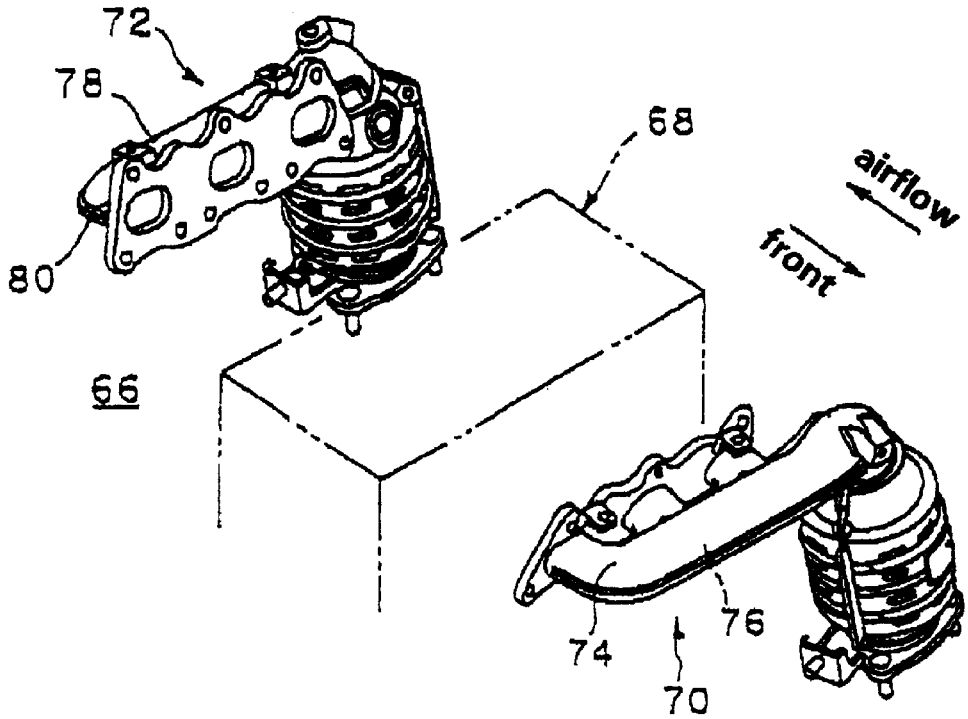
FIG. 8 is a perspective drawing of an exhaust manifold according to a first alternative embodiment.

Referring to FIG. 8, there is shown a second alternative embodiment of the present invention. In this embodiment, a V-shaped internal combustion engine 68 is mounted horizontally in an engine compartment 66 of an automobile (not shown in the figure). Side exhaust manifolds 70 and 72 collect the exhaust gas from the gas columns of internal combustion engine 68. A first exhaust manifold 70 is formed from a first upper case 74 and a first lower case 76. A second exhaust manifold 72 is formed from a second upper case 78 and a second lower case 80.

With exhaust manifolds 70 and 72, first upper case 74, which is positioned toward the front and top of the air current flow, has a thickness of t1, and first lower case 76, which is positioned toward the front and the bottom of the air current flow, has a thickness of t2. Second upper case 78, which is positioned toward the rear and the top of the air current flow, has a thickness of t3, and second lower case 80, which is positioned toward the rear and the bottom of the air current flow, has a thickness of t4. In this case, the thicknesses are formed with t1<t2<=t3<=t4, or t1<=t2<t3<=t4, or t1<=t2<=t3<=t4.

With this structure according to the second alternative embodiment of the present invention, the differences in cooling states based on the positions relative to the air current flow are reflected in exhaust manifolds 70 and 72. This allows upper cases 74 and 78 and lower cases 76 and 80 to be formed appropriately thin without leading to a reduction in strength. As a result, the heat capacity is decreased and less materials are required.

As with the previous embodiment, exhaust manifolds 70 and 72, according to this second alternative embodiment of the present invention, reduces the time required for catalyst 20 to reach its activation temperature, thus allowing catalyst 20 to be quickly activated after the engine is started so that it can purge harmful elements. Also, the structure is made lighter and less expensive.

As with the embodiment shown in FIG. 7, exhaust manifolds 70 and 72, according to the second alternative embodiment of the present invention, are formed so that the thicknesses toward the front, relative to the air flow direction in engine compartment 66, are less than the thicknesses toward the rear, relative to the air flow direction.

Figure 9:
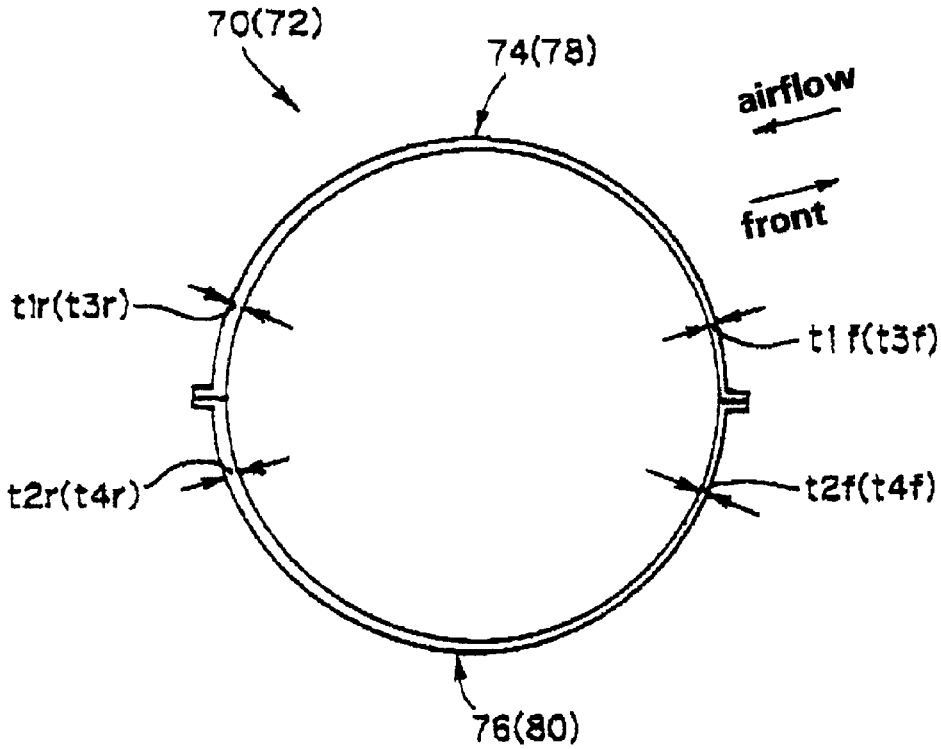
FIG. 9 is an enlarged cross-section drawing of an exhaust manifold according to a first alternative embodiment.

Referring to FIG. 9, in, for example, exhaust manifold 70, the thickness toward the front, relative to the air flow direction, of upper case 74 is t1f, the thickness toward the rear, relative to the air flow direction, of upper case 74 is t1r, the thickness toward the front, relative to the air flow direction, of lower case 76 is t2f, and the thicken toward the rear, relative to the air flow direction of lower case 76 is t2r. The thicknesses are such that at least t1f<t1r or at least t2f<t2r, with the relative values of t1r and t2f being arbitrary. Furthermore, it is also possible to use thicknesses where t1f<t1r<=t2f<=t2r, t1f<=t1r<t2f<=t2r, or t1f<t1r<t2f<t2r.

As with exhaust manifold 70, exhaust manifold 72 is formed so that the thicknesses toward the front and rear, relative to the air flow direction, of upper case 78 are t3f and t3r, and the thicknesses toward the front and rear, relative to the air flow direction, of lower case 80 are t4f and t4r. The thicknesses are such that at least t3f<t3r or at least t4f<t4r, with the relative values of t3r and t4r being arbitrary. Furthermore, it is also possible to use thicknesses where t3f<t3r<=t4f<=t4r, t3f<=t3r<t4f<=t4r, or t3f<t3r<t4f<t4r.

With this structure, exhaust manifolds 70 and 72, according to the second alternative embodiment of the present invention, reflect the different cooling that takes place depending on the position relative to the air flow direction. This allows the thicknesses of upper case 74, lower case 76, upper case 78, and lower case 80 to be formed appropriately thin without resulting in reduced strength. This provides reduced thermal capacity and further reduces the amount of required materials.

Thus, as with the embodiment described above, exhaust manifolds 70 and 72 of the second alternative embodiment of the present invention guide the exhaust gas to catalyst 20 immediately after internal combustion engine 2 is started, without reducing the exhaust gas temperature. This shortens the time required for catalyst 20 to rise to its activation temperature so that, after staring, catalyst 20 is quickly activated to eliminate harmful elements. Furthermore, the resulting structure is made lighter and costs are reduced.

Figure 10:
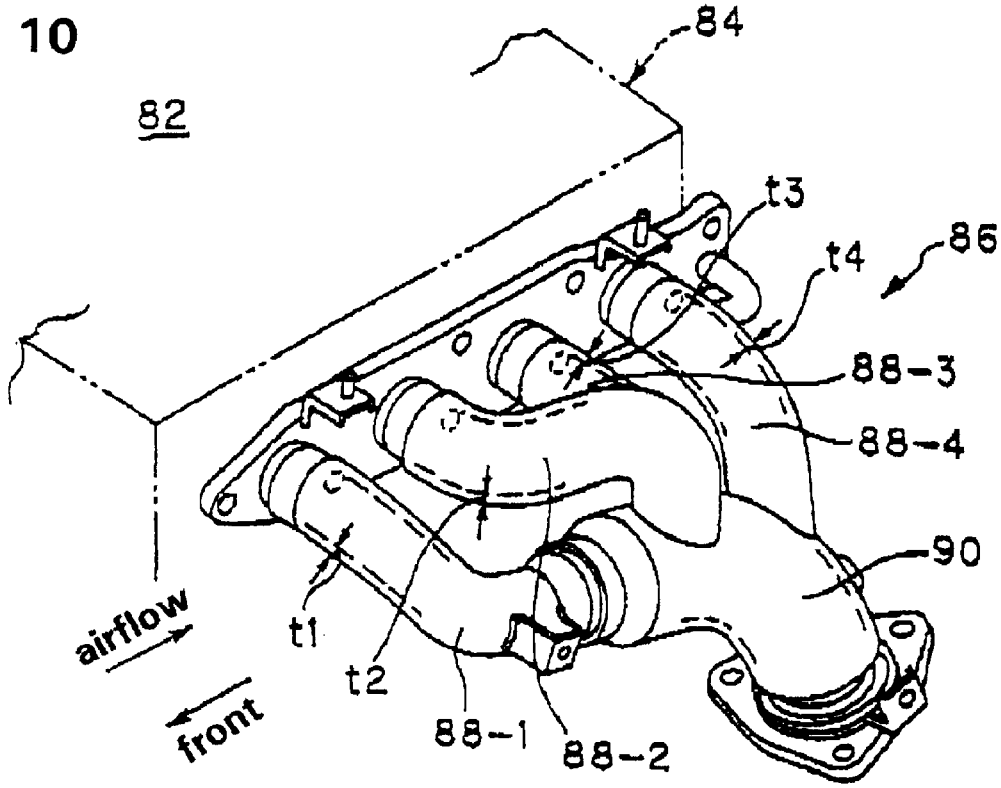
FIG. 10 is a perspective drawing of an exhaust manifold according to a second alternative embodiment.

Referring to FIG. 10, in a third alternative embodiment of the present invention, an exhaust manifold 86 is disposed to collect the exhaust gas from gas columns (not shown in the figure) of an internal combustion engine 84 mounted vertically in an engine compartment 82 of an automobile (not shown in the figure). Exhaust manifold 86 is formed from a collecting pipe 90, formed from a sheet material in a cylindrical shape, and a plurality of branching pipes 88-1–88-4, formed from sheet materials in cylindrical shapes.

Branching pipe 88-1, positioned at the very front relative to the direction of airflow, has a thickness t1, branching pipe 88-2, positioned second from the front relative to the direction of airflow, has a thickness t2, branching pipe 88-3, positioned third from the front relative to the direction of airflow, has a thickness t3, and branching pipe 88-4, positioned at the very rear relative to the direction of airflow, has a thickness t4. The structure is formed so that the thicknesses are t1<t2<=t3<=t4, t1<=t2<t3<=t4, or t1<=t2<=t3<=t4.

With this structure, exhaust manifold 86, according to the third alternative embodiment of the present invention, reflects the differences in cooling states based on the position relative to the direction of airflow. This allows branching pipes 88-1–88-4 to be formed appropriately thin without reducing their strength. As a result, heat capacity is reduced and less materials are required.

Thus, as with the embodiments described above, exhaust manifold 86, according to this third alternative embodiment of the present invention, reduces the time required for catalyst 20 to reach its activation temperature so that catalyst 20 is quickly activated to purge harmful elements after the engine is started. Also, the structure is made lighter and less expensive.

As with the embodiment shown in FIG. 7, exhaust manifold 86, according to the third alternative embodiment of the present invention, is formed so that, for branching pipes 88-1–88-4, the thicknesses toward the front, relative to the direction of airflow in engine compartment 4, is smaller than the thicknesses toward the rear, relative to the direction of airflow.

Figure 11:
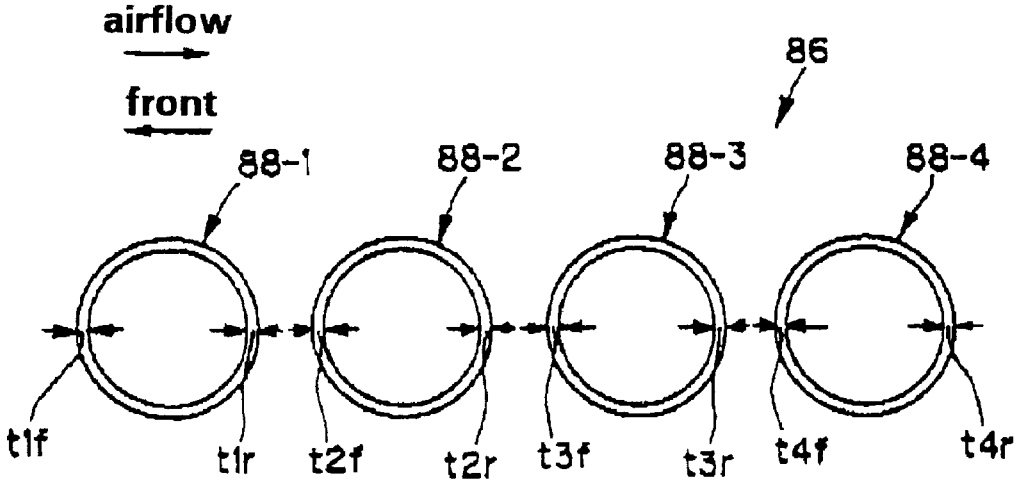
FIG. 11 is an enlarged cross-section drawing of an exhaust manifold according to the second alternative embodiment.
Figure 12:
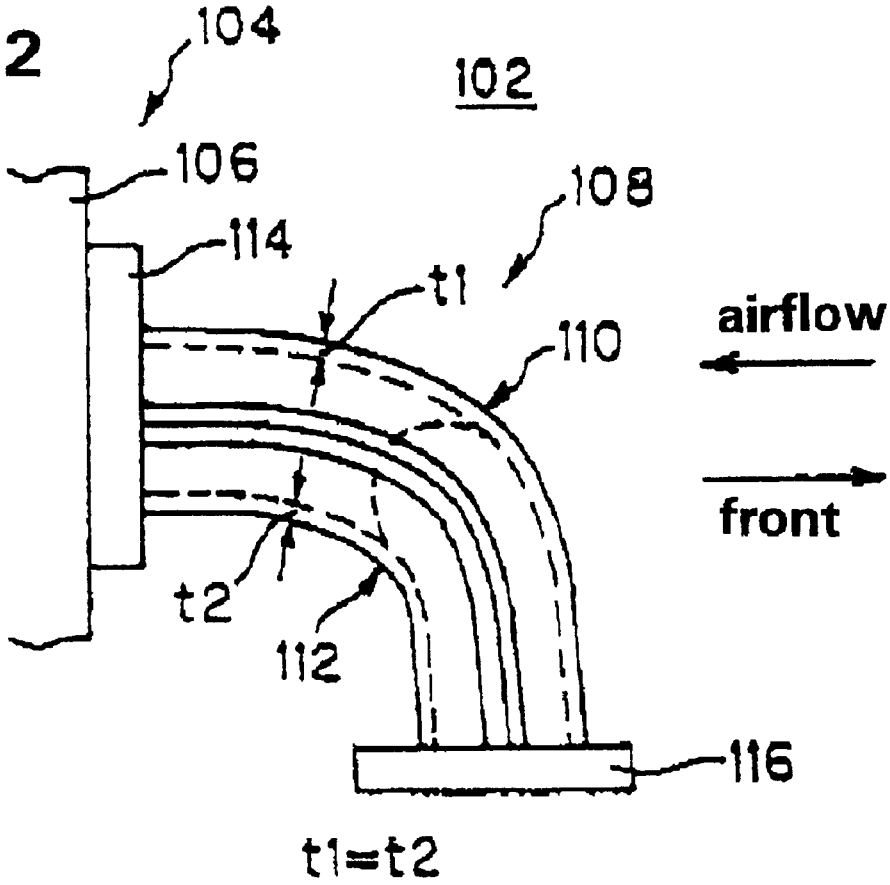
FIG. 12 is a schematic side-view drawing of a conventional exhaust manifold.

Referring to FIG. 11, exhaust manifold 86 can, for example, be formed so that the thicknesses of branching pipe 88-1 toward the front and rear, relative to the direction of airflow, are t1f and t1r, respectively. The thicknesses of branching pipe 88-2 toward the front and rear, relative to the direction of airflow, are t2f and t2r, respectively. The thicknesses of branching pipe 88-3 toward the front and rear, relative to the direction of airflow, are t3f and t3r, respectively. The thicknesses of branching pipe 88-4 toward the front and rear, relative to the direction of airflow, are t4f and t4r, respectively. The structure is formed so that at least t1f<t1r, or at least t2f<t2r, or at least t3f<t3r, or at least t4f<t4r, where the relative sizes of t1r and t2f, t2r and t3f, t3r and t4f are unimportant.

With this structure, exhaust manifold 86, according to this third alternative embodiment of the present invention, reflects the different cooling that takes place depending on the position relative to the direction of airflow. Thus, the thickness of the front and rear, relative to the direction of airflow, of branching pipes 88-1–88-4 is appropriately reduced without resulting in reduced strength. Furthermore, thermal capacity is lowered and the amount of materials required is reduced.

Thus, as with the embodiment described above, exhaust manifold 86 of the third alternative embodiment of the present invention, guides the exhaust gas to catalyst 20 immediately after internal combustion engine 2 is started, without reducing the exhaust gas temperature. This shortens the time required for catalyst 20 to rise to its activation temperature so that, after starting, catalyst 20 is quickly activated to eliminate harmful elements. Furthermore, the structure is made lighter and costs are reduced.

As described above, the exhaust manifold for internal combustion engines according to the present invention takes advantage of the fact that stress tolerance is increased if the manifold is cooled efficiently by being positioned toward the front, relative to the direction of airflow. Thus, the sheet material is formed thin without having the strength reduced. This reduces heat capacity and requires less material.

Since the heat capacity is reduced in this exhaust manifold, the exhaust gas is guided to the catalyst right after the internal combustion engine is started without having the exhaust temperature reduced. This allows the time required for the catalyst to reach the activation temperature to be reduced so that the catalyst is quickly activated right after the engine is started. Also, by reducing the amount of required materials, the structure is made lighter and less expensive.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An exhaust manifold comprising:

at least one structure for receiving exhaust gas from an engine;

said at least one structure having a first section, having a first thickness, which receives auxiliary cooling during operation of said engine, and a second section, having a second thickness;

said second section receiving less auxiliary cooling than said first section;

said first thickness being less than said second thickness;

said exhaust manifold includes at least two sheet materials;

said first section being one of said at least two sheet materials;

said second section being another of said at least two sheet materials; and a catalyst attachment flange attached to said second section.

2. An exhaust manifold according to claim 1, further comprising:

an offset joining section on one of said first section and said second section;

a joining section on the other of said first section and said second section;

said offset joining section mating with said joining section, whereby assembly of said exhaust manifold is accomplished with minimal movement of said first section and said second section.

3. An exhaust manifold according to claim 1, wherein said auxiliary cooling is the result of an air current.

4. An exhaust manifold according to claim 1, further comprising:

a catalyst for reducing harmful elements in said exhaust gas; and said catalyst being positioned near an exit opening of said exhaust manifold, where said exhaust manifold is connectable to further exhaust components.

5. An exhaust manifold according to claim 1, wherein:

at least one of said at least two sheet materials includes has at least a first thickness and a second thickness;

said first thickness being proximal to said auxiliary cooling; and said first thickness being less than said second thickness.

6. An exhaust manifold according to claim 1, further comprising:

a plurality of branching pipes, each receiving an exhaust gas from said internal combustion engine;

a heat attachment flange attaching a first end of said plurality of branching pipes to said internal combustion engine; and a second, opposite end of said plurality of branching pipes connecting to said exhaust manifold.

7. An exhaust manifold for a V-shaped internal combustion engine, comprising:

a first, front manifold structure receiving exhaust gas from a first side of said V-shaped internal combustion engine;

a second, rear manifold structure receiving exhaust gas from a second side of said V-shaped internal combustion engine;

said first, front manifold structure receiving auxiliary cooling from operation of said V-shaped internal combustion engine;

said first, front manifold structure being made from a material having a thickness less than said second, rear manifold structure, thereby reducing an overall heat capacity of said exhaust manifold;

at least one of said first front manifold and said second rear manifold having at least first and second sheet materials;

said first sheet material being proximal to said auxiliary cooling;

said second sheet material being distal from said auxiliary cooling, thereby receiving less auxiliary cooling than said first sheet material;

said first sheet material having a thickness less than said second sheet material; and a catalyst attachment flange attached to said second sheet material.

8. An exhaust manifold for a V-shaped internal combustion engine according to claim 7, wherein said auxiliary cooling is the result of an air current.

9. An exhaust manifold for a V-shaped internal combustion engine according to claim 7, further comprising:

a catalyst for reducing harmful elements in said exhaust gas; and said catalyst being positioned near an exit opening of said exhaust manifold, where said exhaust manifold is connectable to further exhaust components.

10. An exhaust manifold for a V-shaped internal combustion engine according to claim 7, further comprising:

a first plurality of branching pipes, each receiving an exhaust gas from said first side of said V-shaped internal combustion engine;

a second plurality of branching pipes, each receiving an exhaust gas from said second side of said V-shaped internal combustion engine;

first and second heat attachment flanges, attaching a first end of said first and second plurality of branching pipes to said V-shaped internal combustion engine;

a second, opposite end of said first plurality of branching pipes connecting to said first, front manifold; and a second, opposite end of said second plurality of branching pipes connecting to said second, rear manifold.

11. An exhaust manifold for an internal combustion engine comprising;

a plurality of branching pipes, each receiving an exhaust gas from said internal combustion engine;

said plurality of branching pipes connecting to a connecting pipe;

at least one of said plurality of branching pipes having at least a first thickness and a second thickness;

said first thickness receiving auxiliary cooling during operation of said internal combustion engine;

said second thickness receiving less auxiliary cooling than said first thickness; and said first thickness being thinner than said second thickness, thereby reducing an overall heat capacity of said exhaust manifold.

12. An exhaust manifold for an internal combustion engine according to claim 11, wherein said auxiliary cooling is the result of an air current.

13. An exhaust manifold for an internal combustion engine according to claim 11, further comprising:

a catalyst for reducing harmful elements in said exhaust gas; and said catalyst being positioned near an exit opening of said exhaust manifold, where said exhaust manifold is connectable to further exhaust components.

14. An exhaust manifold for an internal combustion engine according to claim 11, further comprising:

a heat attachment flange attaching said plurality of branching pipes to said internal combustion engine.

* * * * *